US011125079B2

(12) United States Patent
Fripp et al.

(10) Patent No.: US 11,125,079 B2
(45) Date of Patent: Sep. 21, 2021

(54) FLOW RATE SIGNALS FOR WIRELESS DOWNHOLE COMMUNICATION

(71) Applicant: Halliburton Energy Services, Inc., Houston, TX (US)

(72) Inventors: Michael Fripp, Carrollton, TX (US); Zachary William Walton, Carrollton, TX (US); Matthew Merron, Carrollton, TX (US); Thomas Frosell, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 52 days.

(21) Appl. No.: 16/314,812

(22) PCT Filed: Aug. 18, 2016

(86) PCT No.: PCT/US2016/047501
§ 371 (c)(1),
(2) Date: Jan. 2, 2019

(87) PCT Pub. No.: WO2018/034662
PCT Pub. Date: Feb. 22, 2018

(65) Prior Publication Data
US 2019/0249549 A1 Aug. 15, 2019

(51) Int. Cl.
*E21B 47/18* (2012.01)
*E21B 34/14* (2006.01)
(Continued)

(52) U.S. Cl.
CPC ..... *E21B 47/18* (2013.01); *E21B 34/066* (2013.01); *E21B 34/14* (2013.01); *E21B 34/16* (2013.01);
(Continued)

(58) Field of Classification Search
CPC ..... E21B 47/18; E21B 34/16; E21B 47/12; E21B 47/138; E21B 34/14; E21B 34/142
See application file for complete search history.

(56) References Cited

U.S. PATENT DOCUMENTS 6,286,596 B1 * 9/2001 Schnatzmeyer ..... E21B 43/12 166/250.15
6,394,181 B2 * 5/2002 Schnatzmeyer ..... E21B 43/12 166/250.15
(Continued)

FOREIGN PATENT DOCUMENTS

WO 2012094242 A2 7/2012
WO 2016/018429 A1 2/2016
WO 2018/093377 A1 5/2018

OTHER PUBLICATIONS

Search Report and Written Opinion issued in related Singapore Application No. 11201810072S dated Jun. 10, 2019, 11 pages.
(Continued)

*Primary Examiner* — Catherine Loikith
(74) *Attorney, Agent, or Firm* — Scott Richardson; Baker Botts L.L.P.

(57) ABSTRACT

A method for using flow rate signals for wireless downhole communication comprises generating a first flow rate signal within a wellbore by altering the flow rate of a first fluid in the well bore, wherein the first flow rate signal comprises at least two detectable characteristics; detecting the first flow rate signal at a first downhole tool disposed within the wellbore; and actuating the first downhole tool in response to detecting the first flow rate signal.

20 Claims, 6 Drawing Sheets

(51) Int. Cl.

| | |
|---|---|
| ***E21B 47/12*** | (2012.01) |
| ***E21B 47/107*** | (2012.01) |
| ***E21B 34/16*** | (2006.01) |
| ***E21B 34/06*** | (2006.01) |
| *E21B 43/14* | (2006.01) |

(52) U.S. Cl.

CPC ..... *E21B 47/107* (2020.05); *E21B 47/12* (2013.01); *E21B 43/14* (2013.01); *E21B 2200/06* (2020.05)

(56) References Cited

U.S. PATENT DOCUMENTS

| | | | |
|---|---|---|---|
| 7,983,113 | B2 | 7/2011 | Krueger et al. |
| 9,010,442 | B2 | 4/2015 | Streich et al. |
| 2003/0016164 | A1 | 1/2003 | Finke et al. |
| 2004/0256113 | A1 | 12/2004 | LoGiudice et al. |
| 2007/0056724 | A1 | 3/2007 | Spring et al. |
| 2007/0235199 | A1 | 10/2007 | Logiudice et al. |
| 2011/0286309 | A1 | 11/2011 | Sugiura |
| 2012/0061095 | A1 | 3/2012 | Capderou |
| 2012/0146805 | A1 | 6/2012 | Vick, Jr. et al. |
| 2013/0020097 | A1 | 1/2013 | Veneruso et al. |
| 2014/0338922 | A1 | 11/2014 | Streich et al. |
| 2016/0177673 | A1 | 6/2016 | Merron et al. |
| 2017/0204693 | A1 | 7/2017 | Von Gynz-Rekowski et al. |

OTHER PUBLICATIONS

International Search Report and Written Opinion issued in related PCT Application No. PCT/US2016/047501 dated Apr. 25, 2017, 13 pages.

Office Action issued in related Canadian Patent Application No. 3024700 dated Oct. 15, 2019, 6 pages.

Search Report and Written Opinion issued in related Danish Application No. PA 2018 00828 dated Aug. 27, 2019, 8 pages.

* cited by examiner

FLOW RATE SIGNALS FOR WIRELESS DOWNHOLE COMMUNICATION

CROSS-REFERENCE TO RELATED APPLICATION

The present application is a U.S. National Stage Application of International Application No. PCT/US2016/047501 filed Aug. 18, 2016, which is incorporated herein by reference in its entirety for all purposes.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

After a wellbore has been formed, various downhole tools may be inserted into the wellbore to extract the natural resources such as hydrocarbons or water from the wellbore, to inject fluids into the wellbore, and/or to maintain the wellbore. At various times during production, injection, and/or maintenance operations, it may be necessary to regulate fluid flow into or out of various portions of the wellbore or various portions of the downhole tools used in the wellbore.

Some downhole tools are operated in part by onboard electronics that receive control signals from operators at the surface. In response to the control signals, the onboard electronics can operate the downhole tool in more complicated ways than are typically possible using hydro-mechanical control alone. However, because of the distance between the surface and the downhole tools, interference created by the formation, generally harsh downhole conditions, and various other factors, communication between the surface and the downhole tools may be difficult. In some cases, magnetic materials, such as magnetic fracture balls, are used to signal electronics within downhole tools. However, such signaling systems limit the properties of materials used and complicate the metallurgy of downhole tools. They may also limit the ability to pass other tools through the system.

BRIEF DESCRIPTION OF THE DRAWINGS

These drawings illustrate certain aspects of some of the embodiments of the present disclosure, and should not be used to limit or define the claims.

Figure 1:
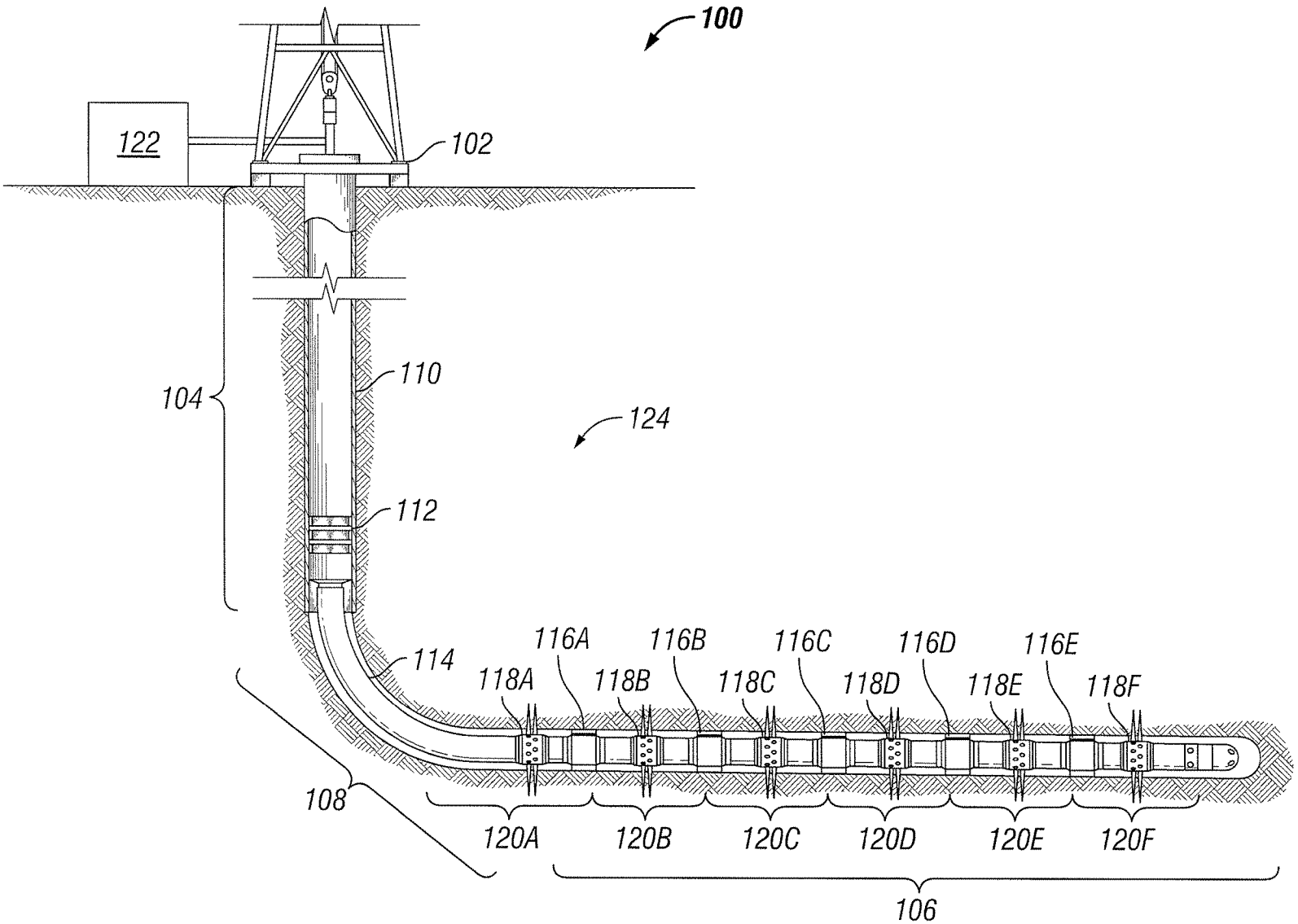
FIG. 1 is a schematic of a well system following a multiple-zone completion operation according to certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, other types of nonvolatile memory, or any combination thereof. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data or instructions or both for a period of time. Computer-readable media may include, for example, without limitation, storage media such as a direct access storage device (for example, a hard disk drive or floppy disk drive), a sequential access storage device (for example, a tape disk drive), compact disk, CD-ROM, DVD, RAM, ROM, electrically erasable programmable read-only memory (EEPROM), flash memory, or any combination thereof; as well as communications media such wires, optical fibers, microwaves, radio waves, and other electromagnetic and/or optical carriers; and/or any combination of the foregoing.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain embodiments may be used in one or more of wireline (including wireline, slickline, and coiled tubing), downhole robot, MWD, and LWD operations.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

The present disclosure relates to methods and systems for using flow rate signals for wireless downhole communication. More specifically, the present disclosure relates to a method comprising: generating a first flow rate signal within a wellbore by altering the flow rate of a first fluid in the wellbore, wherein the first flow rate signal comprises at least two detectable characteristics; detecting the first flow rate signal at a first downhole tool disposed within the wellbore; and actuating the first downhole tool in response to detecting the first flow rate signal.

In certain embodiments, the present disclosure relates to a system comprising: a well flow control configured to generate one or more flow rate signals comprising at least two detectable characteristics in a wellbore; and a downhole tool disposed in the wellbore comprising: one or more actuators; a sensor configured to detect at least one of the one or more flow rate signals; and a controller coupled to the sensor and the one or more actuators and the controller configured to actuate the downhole tool in response to at least one of the one or more flow rate signals.

In certain embodiments, the present disclosure also relates to a system comprising: a well flow control configured to generate one or more flow rate signals comprising at least two detectable characteristics in a wellbore; and a plurality of downhole tools disposed in the wellbore, wherein each of the plurality of downhole tool comprises: one or more actuators; a sensor configured to detect at least one of the one or more flow rate signals; and a controller coupled to the sensor and the one or more actuators and the controller configured to actuate the downhole tool in response to at least one of the one or more flow rate signals.

Among the many potential advantages to the methods and systems of the present disclosure, only some of which are alluded to herein, the methods and systems of the present disclosure provide wireless communication with downhole tools and avoid problems caused by interference created by the formation, harsh downhole conditions, and various other factors that typically make downhole communication difficult. Additionally, unlike magnetic downhole signaling, flow rate signaling does not require specific metallurgy of downhole tools or limit the ability to pass other tools through the system. In certain embodiments, the methods and systems of the present disclosure comprise flow rate signals that comprise at least two detectable characteristics. Such flow rate signals may have an advantage over simpler flow rate signals, which may not be sufficiently distinct from normal flow rate variations to be recognized by a downhole tool, or may not contain sufficient information to perform a desired downhole operation.

Embodiments of the present disclosure and its advantages may be understood by referring to FIGS. 1 through 5, where like numbers are used to indicate like and corresponding parts.

FIG. 1 is a schematic of a well system 100 following a multiple-zone completion operation. Various types of equipment such as a rotary table, drilling fluid or production fluid pumps, drilling fluid tanks (not expressly shown), and other drilling or production equipment may be located at well surface or well site 102. A wellbore extends from a surface and through subsurface formations. The wellbore has a substantially vertical section 104 and a substantially horizontal section 106, the vertical section 104 and horizontal section 106 being connected by a bend 108. The horizontal section 106 extends through a hydrocarbon bearing formation 124. One or more casing strings 110 are inserted and cemented into the vertical section 104 to prevent fluids from entering the wellbore. Fluids may comprise any one or more of formation fluids (such as production fluids or hydrocarbons), water, mud, fracturing fluids, or any other type of fluid that may be injected into or received from the formation 124.

Although the wellbore shown in FIG. 1 includes a horizontal section 106 and a vertical section 104, the wellbore may be substantially vertical (for example, substantially perpendicular to the surface), substantially horizontal (for example, substantially parallel to the surface), or may comprise any other combination of horizontal and vertical sections. While a land-based system 100 is illustrated in FIG. 1, downhole drilling tools incorporating teachings of the present disclosure may be satisfactorily used with drilling equipment located on offshore platforms, drill ships, semi-submersibles, and drilling barges (not expressly shown).

The well system 100 depicted in FIG. 1 is generally known as an open hole well because the casing strings 110 do not extend through the bend 108 and horizontal section 106 of the wellbore. As a result, the bend 108 and horizontal section 106 of the wellbore are "open" to the formation. In another embodiment, the well system 100 may be a closed hole type in which one or more casing strings 110 are inserted in the bend 108 and the horizontal section 106 and cemented in place. In some embodiments, the wellbore may be partially completed (for example, partially cased or cemented) and partially uncompleted (for example, uncased and/or uncemented).

Well system 100 may include a well flow control 122. Although the well flow control 122 is shown as associated with a drilling rig at the well site 102, portions or all of the well flow control 122 may be located within the wellbore. For example, well flow control 122 may be located at well site 102, within wellbore at a location different from the location of a downhole tool, or within a lateral wellbore. In operation, well flow control 122 controls the flow rate of fluids. In one or more embodiments, well flow control 122 may regulate the flow rate of a fluid into or out of the wellbore, into or out of the formation via the wellbore or both. Fluids may include hydrocarbons, such as oil and gas, other natural resources, such as water, a treatment fluid, or any other fluid within a wellbore.

Well flow control 122 may include, without limitation, valves, sensors, instrumentation, tubing, connections, chokes, bypasses, any other suitable components to control fluid flow into and out of wellbore, or any combination thereof. An operator or well flow control 122 or both may control the rate of fluid flow in the wellbore by, for example, controlling a choke or the bypass around a choke at the well site 102. The operator or well flow control 122 or both may control the rate of fluid flow in the wellbore to generate one or more flow rate signals. A flow rate signal may comprise a digital command encoded by any detectable change in flow rate. In certain embodiments, the flow rate signals may correspond to a particular message or communication to be transmitted to a downhole tool.

The embodiment in FIG. 1 includes a top production packer 112 disposed in the vertical section 104 of the wellbore that seals against an innermost surface of the casing string 110. Production tubing 114 extends from the production packer 112, along the bend 108 and extends along the horizontal section 106 of the wellbore. The production tubing 114 may also be used to inject hydrocarbons and other natural resources into the formation 124 via the wellbore. The production tubing 114 may include multiple sections that are coupled or joined together by any suitable mechanism to allow production tubing 114 to extend to a desired or predetermined depth in the wellbore. Disposed along the production tubing 114 may be various downhole tools including packers 116A-E and sleeves 118A-F. The packers 116A-E engage the inner surface of the horizontal section 106, dividing the horizontal section 106 into a series of production zones 120A-F. In some embodiments, suitable packers 116A-E include, but are not limited to compression set packers, swellable packers, inflatable packers, any other downhole tools, equipment, or devices for isolating zones, or any combination thereof.

Each of the sleeves 118A-F is generally operable between an open position and a closed position such that in the open position, the sleeves 118A-F allow communication of fluid between the production tubing 114 and the production zones 120A-F. In one or more embodiments, the sleeves 118A-F may be operable to control fluid in one or more configurations. For example, the sleeves 118A-F may operate in an intermediate configuration, such as partially open, which may cause fluid flow to be restricted, a partially closed configuration, which may cause fluid flow to be less restricted than when partially open, an open configuration which does not restrict fluid flow or which minimally restricts fluid flow, a closed configuration which restricts all fluid flow or substantially all fluid flow, or any position in between.

During production, fluid communication is generally from the formation 124, through the sleeves 118A-F (for example, in an open configuration), and into the production tubing 114. The packers 116A-F and the top production packer 112 seal the wellbore such that any fluid that enters the wellbore below the production packer 112 is directed through the sleeves 118A-F, the production tubing 114, and the top production packer 112 and into the vertical section 104 of the wellbore.

Communication of fluid may also be from the production tubing 114, through the sleeves 118A-F and into the formation 124, as is the case during hydraulic fracturing. Hydraulic fracturing is a method of stimulating production of a well and generally involves pumping specialized fracturing fluids down the well and into the formation. As fluid pressure is increased, the fracturing fluid creates cracks and fractures in the formation and causes them to propagate through the formation. As a result, the fracturing creates additional communication paths between the wellbore and the formation. Communication of fluid may also arise from other stimulation techniques, such as acid stimulation, water injection, and carbon dioxide ($CO_2$) injection.

In wells having multiple zones, such as zones 120A-F of the well system 100 depicted in FIG. 1, it is often necessary to fracture each zone individually. To fracture only one zone, the zone is isolated from other zones and fracturing fluid is prevented from entering the other zones. In one or more embodiments, isolating a zone being fractured may require actuating one or more downhole tools between different configurations, positions, or modes. For example, isolating any one or more zones 120A-F may comprise moving any one or more sliding sleeve tools 118A-F between a closed configuration and an open configuration, engaging or disengaging any one or more packers 116A-E with the wellbore, or changing the configuration of a valve to redirect the fracturing fluid.

Fluids may be extracted from or injected into the wellbore and the production zones 120A-F via the sleeves 118A-F and production tubing 114. For example, production fluids, including hydrocarbons, water, sediment, and other materials or substances found in the formation 124 may flow from the formation and production zones 120A-F into the wellbore through the sidewalls of open hole portions of the wellbore 106 and 108 or perforations in the casing string 110. The production fluids may circulate in the wellbore before being extracted via downhole tools and the production tubing 114. Additionally, injection fluids, including hydrocarbons, water, gasses, foams, acids, and other materials or substances, may be injected into the wellbore and the formation via the production tubing 114 and downhole tools.

Although the well system 100 depicted in FIG. 1 comprises sleeves 118A-F and packers 116A-E, it may comprise any number of additional downhole tools, including, but not limited to screens, flow control devices, slotted tubing, additional packers, additional sleeves, valves, flapper valves, baffles, sensors, and actuators. The number and types of downhole tools may depend on the type of wellbore, the operations being performed in the wellbore, and anticipated wellbore conditions. For example, in certain embodiments, downhole tools may include a screen to filter sediment from fluids flowing into the wellbore. In addition, although the well system 100 depicted in FIG. 1 depicts fracturing tools, the methods and systems of the present disclosure may be used with any downhole tool capable of detecting a flow rate signal for any suitable type of wellbore or downhole operation.

In certain embodiments, a well system 100 may comprise a plurality of downhole tools controlled by one or more flow rate signals. For example, a well system 100 may comprise 1, 2, 5, 10, 15, 20, 30, 40, 50, 100, or any other suitable number of downhole tools. Each downhole tool may be responsive to a different flow rate signal. In certain embodiments, a flow rate signal may be indicative of a command to a plurality of downhole tools In certain embodiments, a well system 100 may be a multilateral well system. For example, in certain embodiments, a downhole tool such as a flapper valve may actuate in response to a flow rate signal to open and close zones in a multilateral well system. In certain embodiments, a flow rate signal may direct a downhole tool in a multilateral well system to guide a fracture ball into one or more zones of the system.

Figure 2:
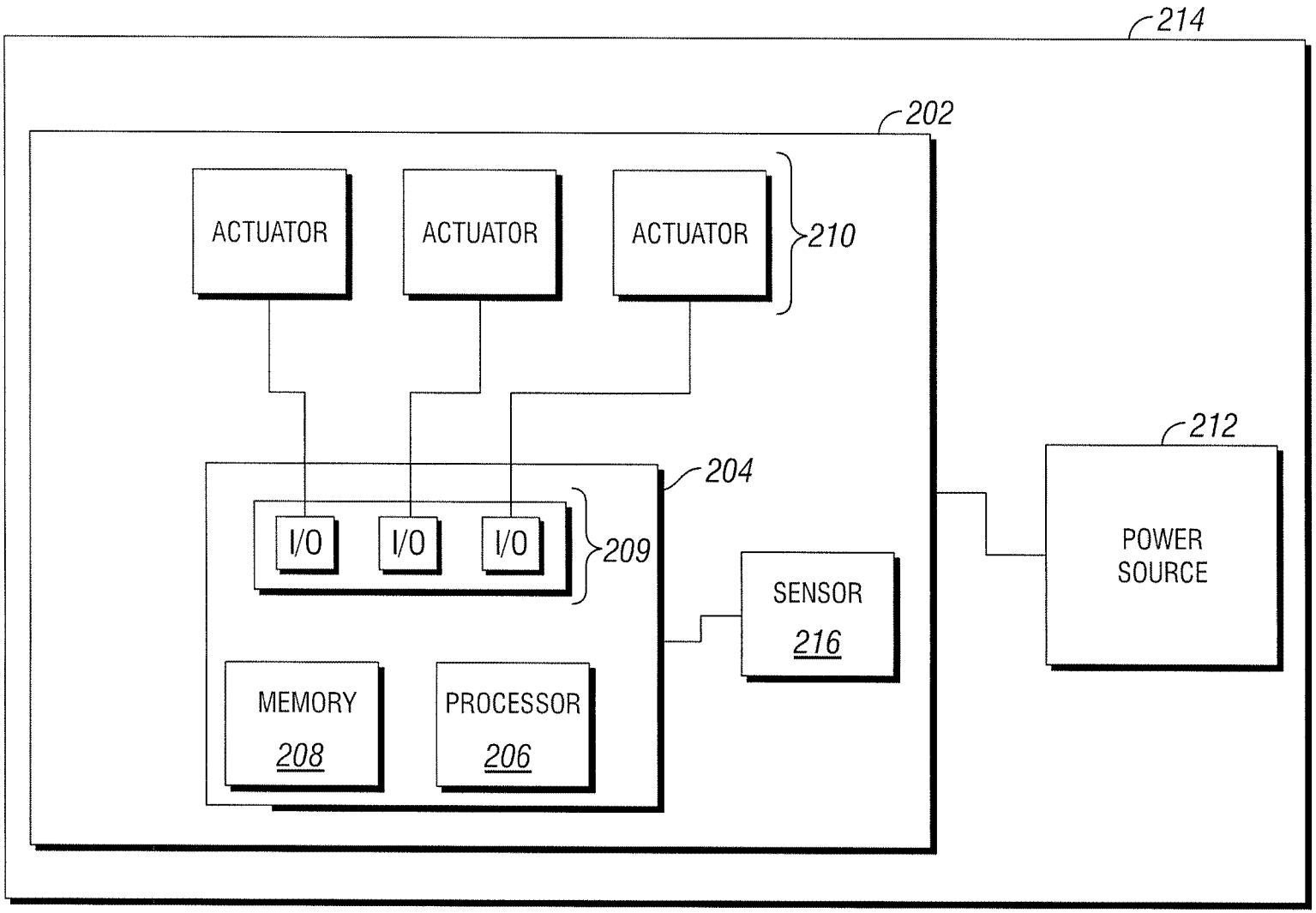
FIG. 2 is a block diagram depicting onboard electronics, actuators, and other electronic components of a downhole tool according to certain embodiments of the present disclosure.

In general, a downhole tool may include onboard electronics and one or more actuators to facilitate operation of the downhole tool. FIG. 2 is a block diagram depicting a configuration of onboard electronics, actuators and other electronic components of a downhole tool. The onboard electronics 202 may include a controller 204 for storing and executing instructions. In general, the controller 204 includes a processor 206 for executing instructions and a memory 208 for storing instructions to be executed by the processor 206 and may further include one or more input/output (I/O) modules 209 for communication between the controller 204 and other electronic components of the downhole tool 214.

The processor 206 may include any hardware, software or both that operates to control and process information. The processor 206 may include, without limitation, a programmable logic device, a microcontroller, a microprocessor, a digital signal processor, any suitable processing device, or any suitable combination of the preceding. The controller 204 may have any suitable number, type, or configuration of processors 206. The processor 206 may execute one or more instructions or sets of instructions to actuate a downhole tool 214, including the steps described below with respect to FIG. 5. The processor 206 may also execute any other suitable programs to facilitate adjustable flow control. The controller 204 may further include, without limitation, switching units, a logic unit, a logic element, a multiplexer, a demultiplexer, a switching element, an I/O element, a peripheral controller, a bus, a bus controller, a register, a combinatorial logic element, a storage unit, a programmable logic device, a memory unit, a neural network, a sensing circuit, a control circuit, a digital to analog converter (DAC), an analog to digital converter (ADC), an oscillator, a memory, a filter, an amplifier, a mixer, a modulator, a demodulator, a power storage device, and/or any other suitable devices.

In one embodiment, the controller 204 communicates with one or more actuators 210 to operate the downhole tool 214 between configurations, positions, or modes. In one embodiment, the actuators 210 convert electrical energy from a power source 212 to move one or more components of the downhole tool 214. For example, in certain embodiments, the actuators 210 may comprise any suitable actuator, including, but not limited to an electromagnetic device, such as a motor, gearbox, or linear screw, a solenoid actuator, a piezoelectric actuator, a hydraulic pump, a chemically activated actuator, a heat activated actuator, a pressure activated actuator, or any combination thereof. For example, in some embodiments, an actuator may be a linear actuator that retracts or extends a pin for permitting or restricting movement of a downhole tool component. In certain embodiments, an actuator 210 may rotate a valve body to redirect a fluid flow through a downhole tool 214. In some embodiments, for example, a downhole tool 214 may comprise a rupture disc, and the controller 204 may communicate with a rupture disc to cause a failure of the rupture disc. The failure of the rupture disc may result in a change in condition (for example, a pressure differential) that may actuate a piston, pin, or other component between one or more positions. In one or more embodiments, an actuator 210 may comprise a valve biased to rotate, and a brake or clutch to prevent rotation of the valve. The controller 204 may communicate with the actuator 210 to operate the brake or clutch to permit rotation of the valve.

The onboard electronics 202 and actuators 210 may be connected to a power source 212. In one embodiment, the power source 212 may be a battery integrated with the downhole tool 214 or integrated with another downhole tool electrically connected to the downhole tool 214. The power source 212 may also be a downhole generator incorporated into the downhole tool 214 or as part of other downhole equipment. In another embodiment, the power source 212 may be located at the surface.

The downhole tool may include at least one sensor 216 for detecting a physical property and converting the property into an electrical signal. The sensor 216 may be coupled to the onboard electronics 202, the controller 204, the processor 206, the memory 208, the I/O modules 209, or any combination thereof. The sensor 216 communicates the electrical signal to the onboard electronics 202. After receiving the electrical signal, the controller 204 may execute instructions based, at least in part, on the electrical signal. One or more of the instructions executed by the controller 204 may include causing the processor to send one or more signals to one or more of the actuators 210, causing the actuators 210 to actuate.

In certain embodiments, the controller 204 may be configured to actuate the downhole tool 214 in response to at least one of one or more flow rate signals. For example, in response to the one or more flow rate signals received by the sensor 216, controller 204 may transmit an actuation or command signal to one or more actuators 210 corresponding to one or more flow rate signals received by the sensors 216. In one or more embodiments, a first flow rate signal may correspond to or be indicative of a first configuration of a sliding sleeve tool 118A-F. For example, when the sensor 216 detects the first flow rate signal, controller 204 may actuate one or more actuators 210 to move at least one sliding sleeve tool 118 from a closed configuration or position to an open configuration or position. As another example, a subsequent flow rate signal may correspond to or be indicative of a closed configuration of at least one sliding sleeve tool 118. When the sensor 216 detects the second flow rate profile, the controller 204 may actuate one or more actuators 210 to move a corresponding sliding sleeve tool 118 from an open configuration to a closed configuration. In one or more embodiments, the onboard electronics 202 of a downhole tool 214 may be configured to recognize one or more flow rate signals indicative of one or more commands. In certain embodiments, a downhole tool 214 may be configured to recognize one or more flow rate signals prior to introduction into a wellbore. Particular flow rate signals may correspond to one or more states of the onboard electronics 202. For example, the one or more states may include, but are not limited to, an indication to communicate one or more commands to adjust a sliding sleeve tool 118 to one or more configurations, a "sleep mode" (such as a low-power mode), a timer state (such as waiting to perform or communicate a command until a specified time delay, semaphore, clock cycle, any other delay, or any combination thereof), or any other mode or state.

Additionally, flow rate signals may be transmitted from a downhole tool 214 to another location, such as well site 102 (shown in FIG. 1) or other downhole tools within the well system 100 using changes in the flow rate of fluid, which may be detected by a sensor 216 located at the well site 102 or associated with another downhole tool. For example, controller 204 may transmit a signal to actuate one or more actuators 210 to increase or decrease the rate of fluid flow through the downhole tool 214 to generate one or more flow rate signals, each of which may correspond to a particular message or communication to be transmitted to well site 102 or another downhole tool.

In one or more embodiments, the sensor 216 may be configured to detect at least one of one or more flow rate signals. In one or more embodiments, the sensor 216 may include, but is not limited to a vibrational sensor, an acoustic sensor, a piezoceramic sensor, a resistive sensor, a Coriolis meter, a Doppler flow meter, a pressure sensor, a temperature sensor, any other sensor suitable to detect a flow rate signal, and any combination thereof. In one or more embodiments, the sensor 216 is not a pressure sensor. In certain embodiments, the sensor 216 may be positioned on the outer wall of a production tubing 114 and may detect the flow of a fluid within the production tubing 114. In one or more embodiments, the sensor 216 does not contact the fluid used to generate the flow rate signal. In one or more embodiments, the fluid used to generate the flow rate signal may pass through a vortex shedder to increase the noise and the detectability of the flow rate.

The sensor 216 converts flow rate signals into electrical signals that reflect one or more characteristics of the flow rate signals. As a result, different flow rate signals may be used to generate different electrical signals. Because the onboard electronics 202 execute instructions based on electrical signals from the sensor 216, different flow rate signals may be used to cause the controller 204 to execute different instructions and to perform different functions of the downhole tool 214. For example, in one embodiment, one flow rate signal may cause the controller 204 to execute an instruction issuing a command to an actuator 210 to move in a first direction, while a subsequent flow rate signal may cause the controller 204 to issue a command to the actuator 210 to move in a second direction. In another embodiment, a flow rate signal may cause the onboard electronics 202 to enter into a "sleep mode," suspending operation of a downhole tool 214 for a period of time in response to detecting the first flow signal. In certain embodiments, a flow rate may cause the onboard electronics 202 not to respond to flow rate signals for a period of time, or until the sensor 216 receives a specific signal to "awaken" the onboard electronics 202.

Flow rate signals may be differentiated by detectable characteristics of the flow rate signal. A detectable characteristic may be any characteristic of a flow rate signal that may be detected by the sensor 216, captured in the electrical signal generated by the sensor 216, and recognized by the onboard electronics 202. In some embodiments, detectable characteristics may be generated by altering the flow rate of a fluid in a manner that is detectable by a sensor 216. In certain embodiments, for example, types of detectable characteristics may include, but are not limited to an increase in flow rate, a decrease in flow rate, a pulse, a delay, a dwell time, a duration time, being within a range of flow rates, remaining under a threshold flow rate, exceeding a threshold flow rate, dropping below a threshold flow rate, crossing a threshold flow rate a certain number of times, a rise time, other suitable detectable characteristics, and any combination thereof.

Flow rate signals may be simple or complex. In certain embodiments, a flow rate signal may comprise changing a flow rate from no flow to some flow, or any flow in between. In one or more embodiments, a flow rate signal may comprise altering the flow rate of a fluid between one or more flow rates. In one or more embodiments, a flow rate signal may comprise altering the flow rate of a fluid between at least two flow rates. In certain embodiments, a flow rate signal may comprise a single detectable characteristic. In certain embodiments, a flow rate signal may comprise one or more detectable characteristics, at least two detectable characteristics, at least three detectable characteristics, at least four detectable characteristics, or any other suitable number of detectable characteristics. In one or more embodiments, flow rate signals may comprise one or more of the same detectable characteristic. For example, a flow rate signal may comprise at least two pulses, of the same or different magnitude. In some embodiments, a flow rate signal may comprise at least two different types of detectable characteristics. For example, a flow rate signal comprising at least two detectable characteristics may be based on a pulse and a rise time.

In some embodiments, a flow rate signal may comprise another flow rate signal. For example, the first flow rate signal may comprise two detectable characteristics, and the second flow rate signal may comprise the same two detectable characteristics of the first flow rate signal, and an additional detectable characteristic. In some embodiments, a first downhole tool 214 may actuate one or more actuators 210 in response to a first flow rate signal, and a second downhole tool 214 may actuate one or more actuators 210 in response to a second flow rate signal, wherein the second flow rate signal comprises the first flow rate signal. In one or more embodiments, different actuators 210, the same actuators 210 or any combination of actuators 210 are actuated by the first downhole tool 214 and the second downhole tool 214.

A flow rate pulse may be a discrete period during which the flow rate is altered from an initial flow rate to an altered flow rate, and then returned to the initial flow rate. An initial flow rate may be any suitable flow rate, including no flow. An altered flow rate may be a flow rate higher or lower than the initial flow rate. A pulse may be based on an absolute or a relative change in flow rate.

In some embodiments, the flow rates of a flow rate signal may be selected to minimize water waste and to avoid damage to the formation. In some embodiments, the flow rates of the flow rate signals may be from about 0 barrels per minute (bbl/min) to about 120 bbl/min, from about 10 bbl/min to about 50 bbl/min, from about 0 bbl/min to about 5 bbl/min, from about 1 bbl/min to about 3 bbl/min, or from about from about 10 bbl/min to about 15 bbl/min. In certain embodiments, the flow rates of the flow rate signal may be based, at least in part, on whether the fluid is being produced or injected. For example, in certain embodiments, a well may produce at around 3 bbl/min and may be injected at around 1 bbl/min. In one or more embodiments, for example, the flow rate of a flow rate signal may vary between 0 bbl/min, 3 bbl/min, 10 bbl/min, and 20 bbl/min.

FIGS. 3A-D are graphs depicting flow rate signals over time for different flow rate signals. The flow rate signals in FIGS. 3A-D are merely illustrative and do not limit the appropriate types of flow rate signals.

Figure 3A:
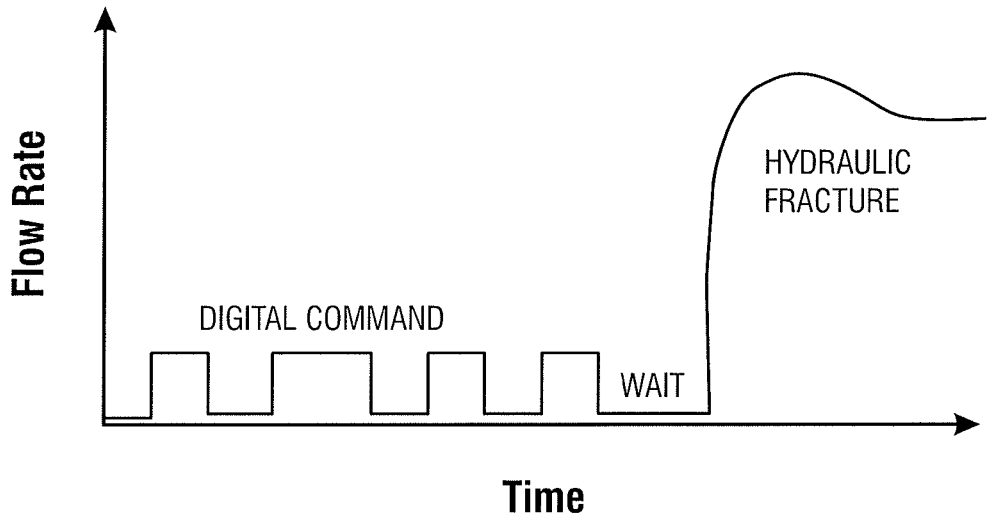
FIGS. 3A-D are a series of graphs representing different flow rate signals according to certain embodiments of the present disclosure.

FIG. 3A depicts one or more flow rate signals in which the detectable characteristic is based on a series of flow rate pulses. For flow rate signals based on flow rate pulses, the onboard electronics 202 may be configured to execute instructions in response to different quantities or patterns of flow rate pulses. For example, the onboard electronics 202 may respond to a total quantity of pulses, a specific number of pulses within a period of time, a delay between pulses, a specific pattern of pulses and delays, or any similar signal. Several possible flow rate signals may be represented by the pulses depicted in FIG. 3A. For example, flow rate signals based on flow rates pulses may include a total of five pulses, three quick pulses in quick succession, or a delay, followed by three quick pulses. Although FIG. 3A depicts a binary flow rate signal of low and high values, the flow rate signal could be non-binary.

Figure 3B:
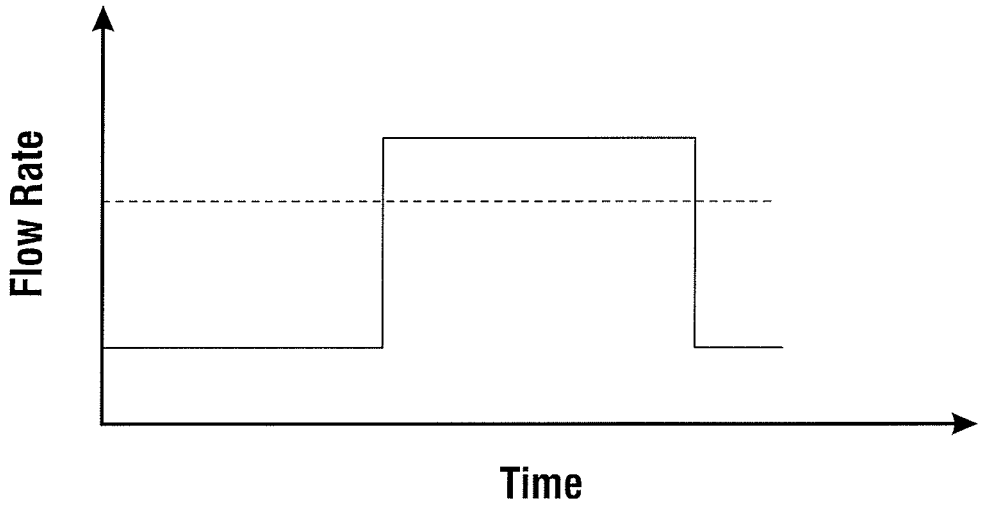

FIG. 3B is a graph illustrating flow rate signals in which the detectable characteristic is based on a flow rate exceeding a threshold flow rate. For flow rate signals based on a threshold flow rate, the onboard electronics 202 may be configured to execute instructions in response to a flow rate being above a threshold flow rate, being within a range of flow rates, remaining under a threshold flow rate, or crossing a threshold flow rate a certain number of times.

Figure 3C:
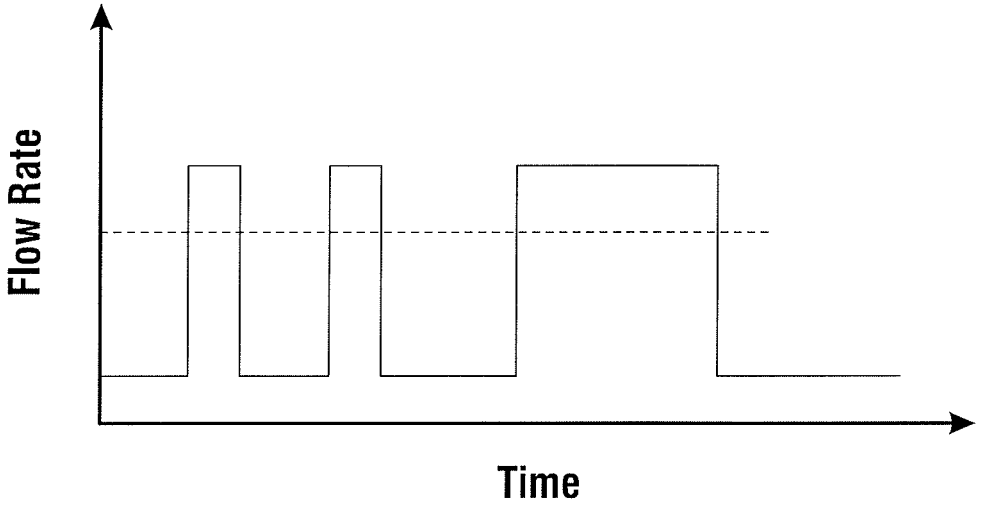

FIG. 3C is a graph illustrating flow rate signals in which the detectable characteristic is based on the duration or dwell time of one or more flow rates. For flow rate signals based on dwell time, the onboard electronics 202 may be configured to execute instructions in response to a fluid flowing at, above, or below a particular flow rate for a particular period of time, or in response to no flow for a particular period of time or both.

Figure 3D:
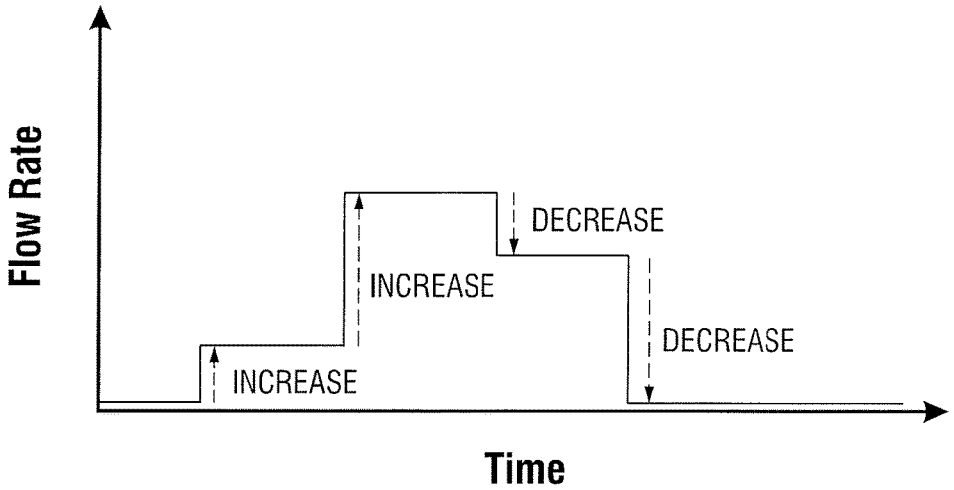

FIG. 3D is a graph illustrating flow rate signals in which the detectable characteristic is based on increases and decreases in flow rate. In certain embodiments, the detectable characteristic may be the amount of flow rate change as well as the duration over which the flow rate remains changed. Accurate measurement of the flow rate may be required in order to detect the amount of flow rate change. In some embodiments, the detectable characteristic may be whether the flow rate increased or decreased more than a threshold amount. Such a detectable characteristic may be independent of the absolute magnitude of the increase or decrease, so long as the increase or decrease in flow rate is above a threshold amount.

For downhole tools 214 configured to respond to two or more flow rate signals, the two or more flow rate signals may or may not be of the same type of signal. For example, in one embodiment, one flow rate signal may be based on a threshold flow rate, while another flow rate signal may be based on a series of flow rate pulses. In another embodiment, a flow rate signal may be based on a first threshold flow rate, while another flow rate signal may be based on a different threshold flow rate.

In certain embodiments, a first downhole tool disposed within a wellbore may be responsive to a first flow rate signal formed in a first fluid and a second downhole tool disposed within the wellbore may be responsive to a second flow rate signal formed in a second fluid. For example, in one embodiment, a first flow rate signal may be generated within a wellbore penetrating at least a portion of a subterranean formation 124 by altering the flow rate of a first fluid and the first flow rate signal may be detected at a first downhole tool in the wellbore. In some embodiments, a second flow rate signal may be generated within the wellbore by alerting the flow rate of a second fluid and the second flow rate signal may be detected at a second downhole tool in the wellbore. The first fluid and the second fluid may be the same or different fluids.

Flow rate signals may be based on absolute flow rates or relative flow rates or both. In certain embodiments, a relative flow rate signal may comprise a percentage increase or decrease with respect to a steady state flow rate. Relative flow rates signals may comprise pulses, thresholds, dwell time components based on a steady state flow or any combination thereof. For example, in some embodiments, a relative flow rate signal may comprise one or more pulses of a 10% increase over a steady state flow rate.

The onboard electronics 202 may also take into account an order in which the flow rate signals or detectable characteristics or both are received by the onboard electronics 202. For example, the onboard electronics 202 may respond to a flow rate signal based on flow rate pulses but only after first detecting another flow rate signal based on a threshold flow rate.

Figure 4A:
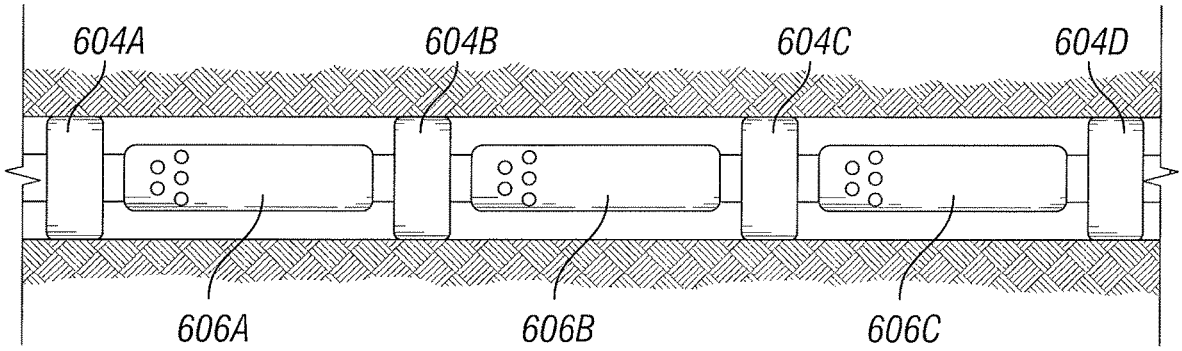
FIGS. 4A-C are schematic views of a downhole tool according to certain embodiments of the present disclosure.

FIG. 4A depicts a portion of a horizontal wellbore having production tubing 114 on which a series of downhole tools 604A-D and 606A-C are disposed. The downhole tools 604A-D and 606A-C may include four packers 604A-D and three sliding sleeve tools 606A-C or any other suitable configuration of packers 604 and sleeve tools 606.

Figure 4B:
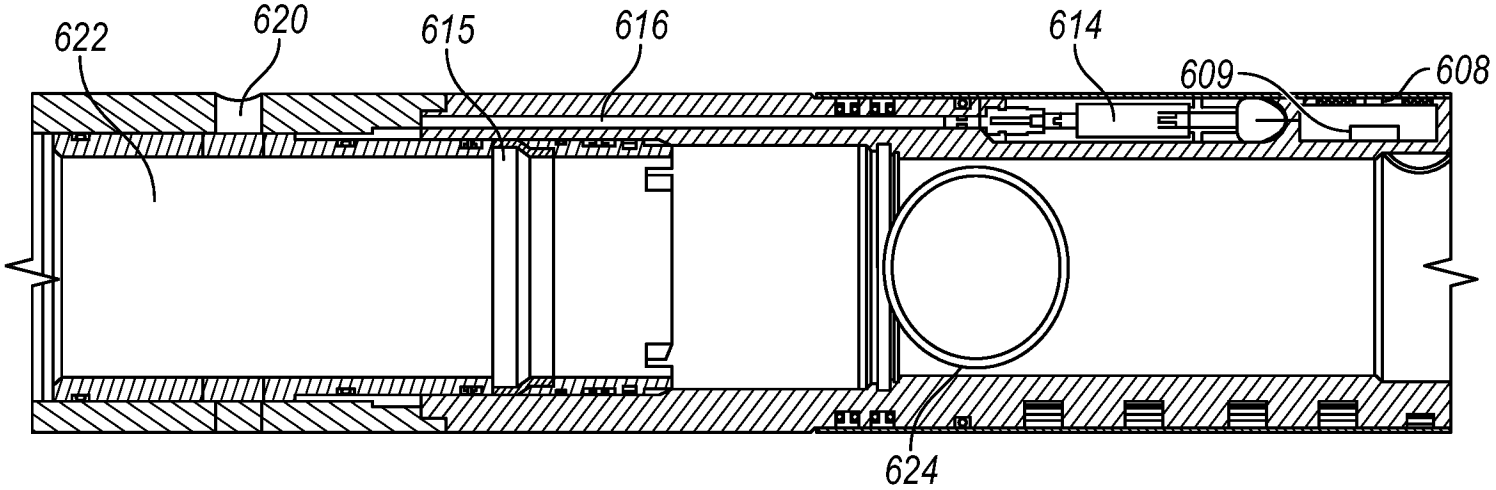
Figure 4C:
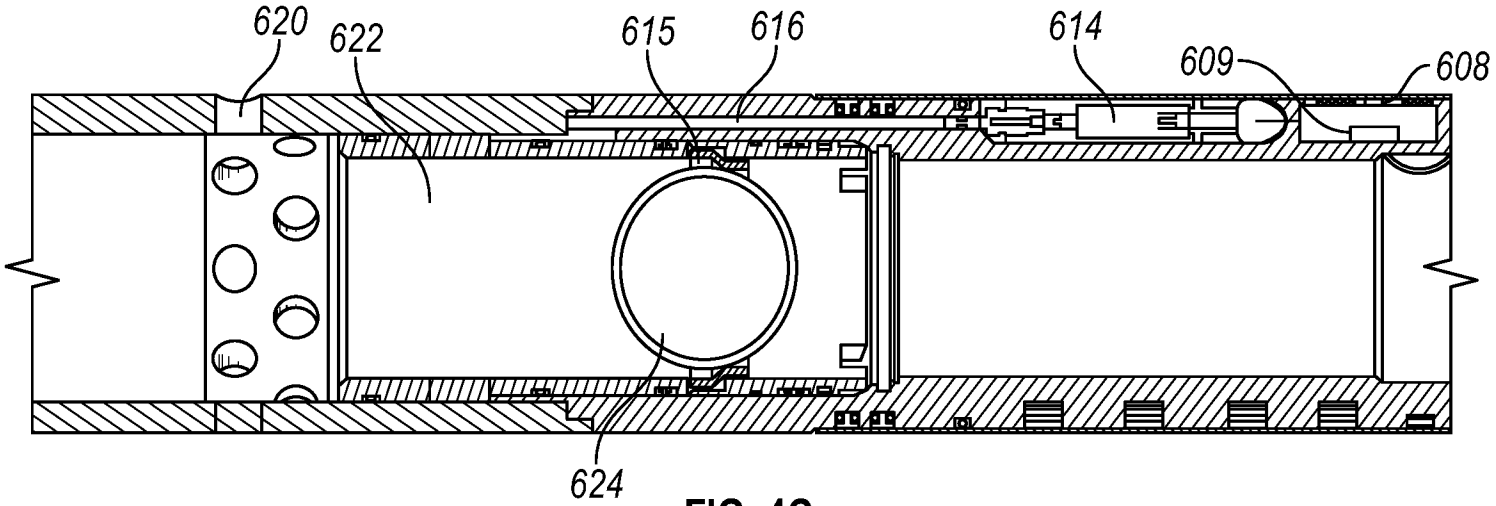

FIGS. 4B and 4C are each detailed views of sliding sleeve tool 606A. FIG. 4B depicts the sliding sleeve tool 606A in a closed configuration while FIG. 4C depicts the sliding sleeve tool 606A in an open configuration. Because the sliding sleeve tools 606A-C are substantially the same, the description of the structure and operation of sliding sleeve tool 606A, below, generally applies to the other sliding sleeve tools 606B-C.

As depicted in FIG. 4B, sliding sleeve tool 606A includes an actuator 614 and onboard electronics 608, which further include a sensor 609. The sensor 609 may be configured to detect one or more flow rate signals. The sliding sleeve tool 606A further includes a collapsible baffle 615. The baffle 615 is configured to collapse when fluid is introduced into a chamber 616 behind the baffle 615.

The sliding sleeve tool 606A includes a series of communication ports 620 around its circumference. The communication ports 620 allow fluid to flow between the production tubing 114 and the formation 124 when the sliding sleeve tool 606A is in the open configuration as depicted in FIG. 4C. In certain embodiments, the sliding sleeve tool 606A may comprise a sleeve 622, which may move from the closed configuration to the open configuration in response to one or more flow rate signals.

By configuring the sliding sleeve tools 606A-C as described, the sliding sleeve tools 606A-C may be sequentially opened. This permits sequential completion of production zones 120A-F adjacent to each sliding sleeve tool 606A-C. To move the sleeve 622 from the closed configuration to the open configuration, a ball 624 is dropped, injected or launched into the wellbore or a flow rate signal signals the sleeve 622. If the baffles 615 are in the open configuration, a ball 624 may pass through the sliding sleeve tool 606A and further down the wellbore. However, if the baffle 615 is collapsed, a ball 624 may be caught by and seal against the baffle 615.

As fluid is pumped into the wellbore, the ball 624 prevents the fluid from flowing through the sliding sleeve tool 606A. This causes hydraulic pressure to build behind the ball 624, exerting a force on the ball 624 and baffle 615. As the pressure continues to build, the force eventually becomes sufficient to slide the sleeve 622 to its open configuration, exposing the ports 620.

In some embodiments, flow rate signals may command baffles 615 within one or more sliding sleeve tools 606A-C to deploy. Deployment of the baffles 615 may cause a ball 624 to land on a particular baffle 615, to have a custom configuration of clusters above the dropped ball 624, or both. In some embodiments, one or more flow rate signals may be used to signal various sliding sleeve tools 606A-C to open and close, eliminating the need to use a ball 624. In certain embodiments, one or more flow rate signals may be used to signal a higher sliding sleeve tool 606 to open and a lower sliding sleeve tool 606 to close. In some embodiments, a flow rate signal may command a sliding sleeve tool 606 to open and a flapper valve to close. One or more flow rate signals may direct a combination of baffles 615 and sliding sleeve tools 606 to deploy in certain configurations.

In certain embodiments, a completion operation may require only one flow rate signal per sliding sleeve tool 606. In some embodiments, sliding sleeve tools 606 may be required to perform additional functions and additional flow rate signals may be required. If an operation is carried out that requires flow rates changes that are similar to a flow rate signal recognized by a sliding sleeve tool 606, such an operation may cause the onboard electronics 608 of a sliding sleeve tool 606 to detect false signals and actuate out of sequence.

To prevent out of sequence actuation, the sliding sleeve tools 606 may be configured to respond to a toggle flow rate signal that toggles the sliding sleeve tool 606 into and out of a "sleep" mode. During sleep mode, all functions of the sliding sleeve tool 606, including actuating in response to flow rate signals, are suspended until the toggle flow rate signal is used to "wake" the sliding sleeve tool. An alternative to sleep mode is for the sliding sleeve tools to respond to a reset flow rate signal by resetting themselves. In certain embodiments, the resetting could be a resetting of the logic within the onboard electronics 608. Specifically, a flow rate signal may be used to reset the detection of flow rate signals for one or more of the sliding sleeve tools 606.

Figure 5:
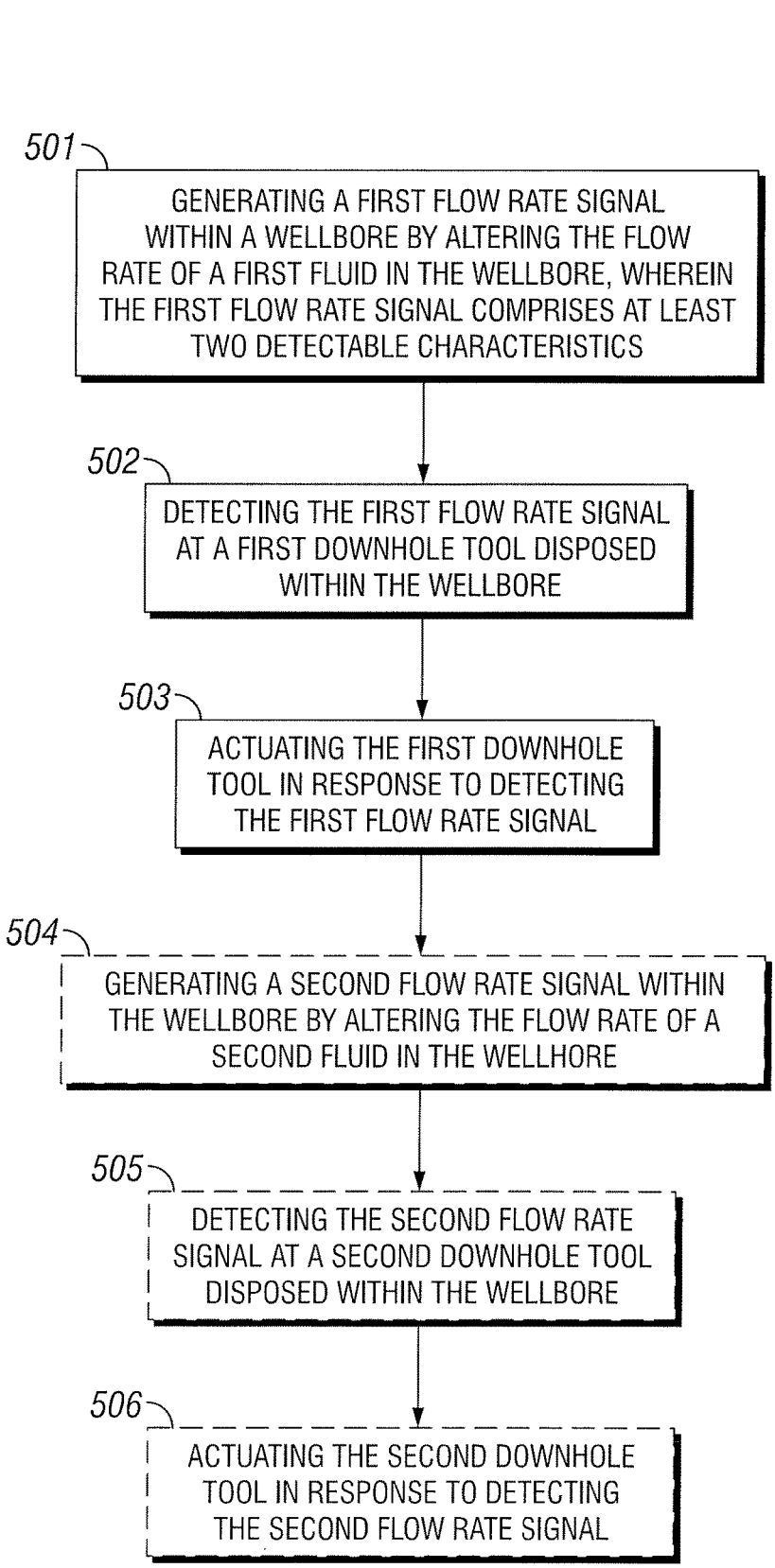
FIG. 5 is a process flow diagram for actuating a downhole tool in response to a flow rate signal according to certain embodiments of the present disclosure.

FIG. 5 is a flowchart of a method according to certain embodiments of the present disclosure. The steps of method 500 may be performed by various computer programs or non-transitory computer readable media that may include instructions operable to perform, when executed, one or more of the steps described below. The programs and computer readable media may be configured to direct a processor or other suitable unit to retrieve and execute the instructions from the computer readable media.

At step 501, a first flow rate signal is generated within a wellbore penetrating at least a portion of a subterranean formation 124. For example, as discussed with reference to FIG. 1, a well flow control 122, an operator, or both may alter the flow rate of fluid in the wellbore. The well flow control 122, operator, or both may be configured to generate one or more flow rate signals. The first flow rate signal may comprise at least two detectable characteristics, as discussed above. In certain embodiments, the first flow rate signal may be based on flow rate pulses, on the flow rate exceeding a threshold flow rate, on duration or dwell time at a flow rate, or any combination thereof, as discussed above with respect to FIGS. 3A-C.

At step 502, a first flow rate signal may be detected at a first downhole tool 214 disposed within the wellbore. The first downhole tool 214 may be located remotely from the well flow control 122, operator, or both that altered the flow rate of the fluid. As discussed above with respect to FIG. 1, the first downhole tool 214 may include a sensor capable of receiving or detecting a change in a parameter related to fluid flowing in the wellbore.

At step 503, the first downhole tool is actuated in response to detecting the first flow rate signal. For example, as discussed with reference to FIG. 2, a sensor 216 may transmit a signal to controller 204 indicating the detection of the first flow rate signal. The controller 204 may actuate one or more actuators 210 of the first downhole tool in response to the first flow rate signal. For example, in certain embodiments, the first downhole tool may be a sliding sleeve tool 606 and the actuating may change the sliding sleeve tool 606 from a closed configuration to an open configuration, or from an open configuration to a closed configuration, in response to the detection of the first flow rate signal. In some embodiments, the method 500 may further comprise steps 504-506.

At step 504, a second flow rate signal may be generated within the wellbore by altering the flow rate of the fluid in the wellbore. As discussed above with respect to step 501, the well flow control 122, operator, or both may control the flow rate of the fluid to generate the flow rate signal. The second flow rate signal may comprise a single detectable characteristic, at least two detectable characteristics, at least three detectable characteristics, or any suitable number of detectable characteristics.

At step 505, a second flow rate signal may be detected at a second downhole tool disposed within the wellbore, similar to step 502. The second downhole tool may be located remotely from the well flow control 122, or operator or both that altered the flow rate of the fluid. As discussed above with respect to FIG. 2, the second downhole tool may include a sensor 216 capable of receiving or detecting a change in a parameter related to fluid flowing in the wellbore.

At step 506, the second downhole tool is actuated in response to detecting the first flow rate signal. For example, as discussed with reference to FIG. 2, a sensor 216 may transmit a signal to controller 204 indicating the detection of the second flow rate signal. The controller 204 may actuate one or more actuators 210 of the second downhole tool in response to the second flow rate signal. The second downhole tool may be the same or a different type of tool from the first downhole tool. In certain embodiments, for example, the first downhole tool may be a sliding sleeve tool 606 and the second downhole tool may be a valve, and the first or second flow rate signals or both may operate to actuate the sliding sleeve tool 606 and valve to carry out a wellbore operation, such as fracturing.

Modifications, additions, or omissions may be made to method 500 without departing from the scope of the present disclosure. For example, the order of the steps may be performed in a different manner than that described and some steps may be performed at the same time. Additionally, each individual step may include additional steps without departing from the scope of the present disclosure.

An embodiment of the present disclosure is a method comprising: generating a first flow rate signal within a wellbore by altering the flow rate of a first fluid in the wellbore, wherein the first flow rate signal comprises at least two detectable characteristics; detecting the first flow rate signal at a first downhole tool disposed within the wellbore; and actuating the first downhole tool in response to detecting the first flow rate signal.

In one or more embodiments described in the preceding paragraph, the method further comprises: generating a second flow rate signal within the wellbore by altering the flow rate of a second fluid in the wellbore; detecting the second flow rate signal at a second downhole tool disposed within the wellbore; and actuating the second downhole tool in response to detecting the second flow rate signal. In certain embodiments, the first downhole tool is a sliding sleeve tool and the second downhole tool is a valve or a baffle. In some embodiments, the first downhole tool and the second downhole tool are sliding sleeve tools.

In one or more embodiments described in the preceding paragraph, the second flow rate signal is the same as the first flow rate signal.

In one or more embodiments described in the preceding two paragraphs, the first fluid is the same as the second fluid.

In one or more embodiments described in the preceding four paragraphs, each of the at least two detectable characteristics comprises one or more of an increase in flow rate, a decrease in flow rate, a pulse, a delay, a dwell time, a duration time, being within a range of flow rates, remaining under a threshold flow rate, exceeding a threshold flow rate, dropping below a threshold flow rate, crossing a threshold flow rate a certain number of times, and a rise time.

In one or more embodiments described in the preceding five paragraphs, the first downhole tool is a sliding sleeve tool.

In one or more embodiments described in the preceding paragraph, the actuating comprises changing the sliding sleeve tool from a closed configuration to an open configuration.

In one or more embodiments described in the preceding two paragraphs, the method further comprises detecting the first flow rate signal at a valve disposed within the wellbore and actuating the valve in response to detecting the first flow rate signal at the valve.

In one or more embodiments described in the preceding eight paragraphs, the first downhole tool comprises one or more of a vibrational sensor, an acoustic sensor, a piezoceramic sensor, a resistive sensor, a Coriolis meter and a Doppler flow meter.

In one or more embodiments described in the preceding nine paragraphs, the method further comprises suspending operation of the first downhole tool for a period of time in response to detecting the first flow rate signal.

Another embodiment of the present disclosure is a system comprising: a well flow control configured to generate one or more flow rate signals comprising at least two detectable characteristics in a wellbore; and a downhole tool disposed in the wellbore comprising: one or more actuators; a sensor configured to detect at least one of the one or more flow rate signals; and a controller coupled to the sensor and the one or more actuators and configured to actuate the downhole tool in response to at least one of the one or more flow rate signals.

In one or more embodiments described in the preceding paragraph, the system further comprises a production string disposed within the wellbore to which the downhole tool is coupled.

In one or more embodiments described in the preceding two paragraphs, the downhole tool is selected from the group consisting of a sliding sleeve tool, a packer, and a valve.

In one or more embodiments described in the preceding three paragraphs, each of the at least two detectable characteristics comprises one or more of an increase in flow rate, a decrease in flow rate, a pulse, a delay, a dwell time, a duration time, being within a range of flow rates, remaining under a threshold flow rate, exceeding a threshold flow rate, dropping below a threshold flow rate, crossing a threshold flow rate a certain number of times, and a rise time.

Another embodiment of the present disclosure is a system comprising: a well flow control configured to generate one or more flow rate signals comprising at least two detectable characteristics in a wellbore; and a plurality of downhole tools disposed in the wellbore, wherein each of the plurality of downhole tool comprises: one or more actuators; a sensor configured to detect at least one of the one or more flow rate signals; and a controller coupled to the sensor and the one or more actuators and the controller configured to actuate the downhole tool in response to at least one of the one or more flow rate signals.

In one or more embodiments described in the preceding paragraph, the system further comprises a production string disposed within the wellbore to which the plurality of downhole tools are coupled.

In one or more embodiments described in the preceding two paragraphs, each of the plurality of downhole tools are selected from the group consisting of: a sliding sleeve tool, a packer, and a valve.

In one or more embodiments described in the preceding three paragraphs, each of the at least two detectable characteristics comprises one or more of an increase in flow rate, a decrease in flow rate, a pulse, a delay, a dwell time, a duration time, being within a range of flow rates, remaining under a threshold flow rate, exceeding a threshold flow rate, dropping below a threshold flow rate, crossing a threshold flow rate a certain number of times, and a rise time.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A method comprising:

generating a first flow rate signal within a wellbore by altering a flow rate of a first fluid in the wellbore, wherein the first flow rate signal comprises at least two detectable characteristics, wherein the at least two detectable characteristics comprise a change in the flow rate and a duration over which the flow rate remains changed, and wherein the first fluid is a formation fluid received from a formation through which the wellbore extends;

detecting the first flow rate signal at a first downhole tool disposed within the wellbore; and actuating the first downhole tool in response to detecting the first flow rate signal, wherein the actuating comprises actuating the first downhole tool in response to the change in the flow rate and the duration over which the flow rate remains changed.

2. The method of claim 1, further comprising:

generating a second flow rate signal within the wellbore by altering a flow rate of a second fluid in the wellbore;

detecting the second flow rate signal at a second downhole tool disposed within the wellbore; and actuating the second downhole tool in response to detecting the second flow rate signal.

3. The method of claim 2, wherein the second flow rate signal is the same as the first flow rate signal.

4. The method of claim 2, wherein the first fluid is the same as the second fluid.

5. The method of claim 2, wherein the first downhole tool is a sliding sleeve tool and the second downhole tool is a valve or a baffle.

6. The method of claim 2, wherein the first downhole tool and the second downhole tool are sliding sleeve tools.

7. The method of claim 1, wherein each of the at least two detectable characteristics comprises one or more of an increase in flow rate, a decrease in flow rate, a pulse, a delay, a dwell time, a duration time, being within a range of flow rates, remaining under a threshold flow rate, exceeding a threshold flow rate, dropping below a threshold flow rate, crossing a threshold flow rate a certain number of times, and a rise time.

8. The method of claim 1, wherein the first downhole tool is a sliding sleeve tool.

9. The method of claim 8, wherein actuating comprises changing the sliding sleeve tool from a closed configuration to an open configuration.

10. The method of claim 8, further comprising detecting the first flow rate signal at a valve disposed within the wellbore and actuating the valve in response to detecting the first flow rate signal at the valve.

11. The method of claim 1, wherein the first downhole tool comprises one or more of a vibrational sensor, an acoustic sensor, a piezoceramic sensor, a resistive sensor, a Coriolis meter and a Doppler flow meter.

12. The method of claim 1, further comprising suspending operation of the first downhole tool for a period of time in response to detecting a second flow rate signal.

13. A system comprising:

a well flow control configured to generate one or more flow rate signals comprising at least two detectable characteristics in a wellbore, wherein the at least two detectable characteristics comprise a change in flow rate and a duration over which the flow rate remains changed, wherein the one or more flow rate signals are associated with a formation fluid received from a formation through which the wellbore extends; and a downhole tool disposed in the wellbore comprising:

one or more actuators;

a sensor configured to detect at least one of the one or more flow rate signals; and a controller coupled to the sensor and the one or more actuators and configured to actuate the downhole tool in response to at least one of the one or more flow rate signals, wherein the actuating comprises actuating the first downhole tool in response to the change in the flow rate and the duration over which the flow rate remains changed.

14. The system of claim 13, further comprising a production string disposed within the wellbore to which the downhole tool is coupled.

15. The system of claim 13, wherein the downhole tool is selected from the group consisting of a sliding sleeve tool, a packer, and a valve.

16. The method of claim 13, wherein each of the at least two detectable characteristics comprises one or more of an increase in flow rate, a decrease in flow rate, a pulse, a delay, a dwell time, a duration time, being within a range of flow rates, remaining under a threshold flow rate, exceeding a threshold flow rate, dropping below a threshold flow rate, crossing a threshold flow rate a certain number of times, and a rise time.

17. A system comprising:

a well flow control configured to generate one or more flow rate signals comprising at least two detectable characteristics in a wellbore, wherein the at least two detectable characteristics comprise a change in flow rate and a duration over which the flow rate remains changed, wherein the one or more flow rate signals are associated with a formation fluid received from a formation through which the wellbore extends; and a plurality of downhole tools disposed in the wellbore, wherein each of the plurality of downhole tool comprises:

one or more actuators;

a sensor configured to detect at least one of the one or more flow rate signals; and a controller coupled to the sensor and the one or more actuators and the controller configured to actuate the downhole tool in response to at least one of the one or more flow rate signals, wherein the actuating comprises actuating the first downhole tool in response to the change in the flow rate and the duration over which the flow rate remains changed.

18. The system of claim 17, further comprising a production string disposed within the wellbore to which the plurality of downhole tools are coupled.

19. The system of claim 17, wherein each of the plurality of downhole tools are selected from the group consisting of: a sliding sleeve tool, a packer, and a valve.

20. The system of claim 17, wherein each of the at least two detectable characteristics comprises one or more of an increase in flow rate, a decrease in flow rate, a pulse, a delay, a dwell time, a duration time, being within a range of flow rates, remaining under a threshold flow rate, exceeding a threshold flow rate, dropping below a threshold flow rate, crossing a threshold flow rate a certain number of times, and a rise time.

* * * * *